US006326053B1

(12) United States Patent
Stump et al.

(10) Patent No.: US 6,326,053 B1
(45) **Date of Patent: *Dec. 4, 2001**

(54) METHOD OF MAKING PAVEMENT MARKINGS HAVING RAISED PROTUBERANCES

(75) Inventors: Larry K. Stump, Hudson, WI (US); Gregory F. Jacobs, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/342,615

(22) Filed: Jun. 29, 1999

Related U.S. Application Data

(62) Division of application No. 08/895,132, filed on Jul. 16, 1997, now abandoned.

(51) Int. Cl.[7] ..... G02B 5/128; E01F 9/04

(52) U.S. Cl. ..... 427/163.4; 427/197; 427/204; 156/309.6; 156/298; 156/280; 156/279

(58) Field of Search ..... 427/137, 163.4, 427/195, 197, 204; 156/297, 298, 279, 280, 309.6; 264/1.31, 1.34; 359/531, 536, 540; 404/14

(56) References Cited

U.S. PATENT DOCUMENTS

| | | | |
|---|---|---|---|
| 3,043,196 | 7/1962 | Palmquist et al. | 88/82 |
| 3,171,827 | 3/1965 | De Vries et al. | 260/40 |
| 3,175,935 | 3/1965 | Vanstrum | 156/3 |
| 3,247,005 * | 4/1966 | Parry et al. | 427/197 |
| 3,274,888 | 9/1966 | Vanstrum et al. | 88/82 |
| 3,418,896 | 12/1968 | Rideout | 94/1.5 |
| 3,556,637 | 1/1971 | Palmquist | 350/105 |
| 4,035,059 | 7/1977 | DeMaster | 350/105 |
| 4,490,432 | 12/1984 | Jordan | 428/220 |
| 4,564,556 | 1/1986 | Lange | 428/325 |
| 4,758,469 | 7/1988 | Lange | 428/325 |
| 4,772,511 | 9/1988 | Wood et al. | 428/325 |
| 4,931,414 | 6/1990 | Wood et al. | 501/103 |
| 4,937,127 | 6/1990 | Haenggi et al. | 428/148 |
| 4,983,458 | 1/1991 | Dejaiffe | 428/402 |
| 4,988,541 | 1/1991 | Hedblom | 427/163 |
| 4,988,555 | 1/1991 | Hedblom | 428/172 |
| 5,053,253 | 10/1991 | Haenggi et al. | 427/204 |
| 5,094,902 | 3/1992 | Haenggi et al. | 428/150 |
| 5,124,187 | 6/1992 | Aeschbacher et al. | 428/40 |
| 5,194,113 | 3/1993 | Lasch et al. | 156/243 |
| 5,286,682 | 2/1994 | Jacobs et al. | 501/34 |
| 5,417,515 | 5/1995 | Hachey et al. | 404/15 |
| 5,643,655 | 7/1997 | Passarino | 428/143 |
| 5,750,191 | 5/1998 | Hachey et al. | 427/185 |
| 5,777,791 | 7/1998 | Hedblom | 359/536 |
| 5,941,655 | 8/1999 | Jacobs et al. | 404/14 |

FOREIGN PATENT DOCUMENTS

| | | | |
|---|---|---|---|
| 0 373 826 A2 | 6/1990 | (EP) . | |
| 0 397 406 A1 | 11/1990 | (EP) . | |
| 0 565 756 A1 | 10/1993 | (EP) | G03C/7/00 |
| 0 683 268 A2 | 11/1995 | (EP) . | |
| 0 683 269 A2 | 11/1995 | (EP) . | |
| 5-33661 | 2/1993 | (JP) | F02B/31/02 |

* cited by examiner

*Primary Examiner*—Michael W. Ball
*Assistant Examiner*—Barbara J. Musser
(74) *Attorney, Agent, or Firm*—Rudolph P. Hofmann, Jr.

(57) ABSTRACT

Retroreflective article (10), e.g., in the form of a pavement marking, having raised, nonintegral protuberances (16) that exhibit good dry retroreflectivity and recover retroreflectivity quickly after exposure to water. The protuberance comprise a thermoplastic polymer body. Partially embedded in the protuberance are optical elements (14) which are in optical association with a light scattering agent. The protuberance is disposed on top of a conformable base sheet (12).

20 Claims, 3 Drawing Sheets

METHOD OF MAKING PAVEMENT MARKINGS HAVING RAISED PROTUBERANCES

This is a divisional of application Ser. No. 08/895,132 filed Jul. 16, 1997 now abandoned.

TECHNICAL FIELD

The present invention pertains to a retroreflective pavement marking that uses raised, nonintegral protuberances to exhibit good retroreflective brightness under dry and wet conditions.

BACKGROUND

Pavement markings—e.g., paints, tapes, and individually mounted articles—are used commonly to guide and direct motorists traveling along a roadway. During the daytime, the markings are usually sufficiently visible to guide motorists. At night, however, when the primary source of illumination is the vehicle headlights, the marking may not be sufficiently bright to guide the motorist unless it retroreflects light. Retroreflective pavement markings have the ability to return substantial quantities of incident light in the direction from which the light originated. For this reason, retroreflective pavement markings are commonplace on roadways.

Many retroreflective pavement markings, such as lines on highways, are made by dropping optical elements, such as glass beads, onto the line while it is still tacky. Others are made by securing optical elements to a base sheet that contains pigments and fillers. Securement of the optical elements can be achieved either by embedding the elements into the base sheet or by securing the elements to the base sheet with a binder. The pigments and fillers typically are dispersed throughout the base sheet for several reasons, such as reducing cost, improving durability, and providing conformability. Pigments also enhance pavement marking visibility and can play a role in the retroreflective mechanism.

Incident light retroreflects from pavement markers in the following manner. First, the incident light passes through the optical elements to strike the pigments in the base sheet or in the bonding material of the marker. The pigments then scatter the incident light back into the microspheres, and the microspheres redirect a portion of the scattered light back towards the light source. For effective retroreflection from pavement markings, especially under wet conditions, the microspheres preferably are elevated above the pavement surface so that they will not be submerged in water during a rainy period.

An example of a pavement marker where the microspheres are elevated is disclosed in U.S. Pat. No. 4,988,555 (Hedblom). This pavement marker contains a pattern of protrusions that have vertical surfaces where microspheres are embedded so as to be elevated above the pavement surface. The microspheres are elevated and are oriented vertical to the incident light, providing for more efficient retroreflection. Because of their elevated position, the microspheres often are not completely submerged in water. The protrusions also allow the retroreflective portions of the marking to drain more efficiently and recover retroreflective performance more quickly after cessation of rainfall.

While patterned pavement markers have become very useful articles, their manufacturing process is somewhat complex. For example, as disclosed in U.S. Pat. No. 4,988,541 (Hedblom), the integral protrusions are created by embossing a sheet of polymeric material using an embossing roll that has a predetermined pattern of recesses. As the polymeric material fills the recesses in the embossing roll, protrusions having set pattern, dimensions, and spacing are formed. After the embossing process, binder materials are carefully placed on the protrusions in a manner that keeps the binder from flowing into the valleys between the protrusions. Microspheres and/or skid resistant particles are then secured to the binder material. Not only is this process somewhat complicated, but changing the protrusion pattern or shape, size, or spacing requires changing the embossing roll, which typically requires labor and extended amounts of time. With each different protrusion pattern, there must be a corresponding embossing roll.

Japanese Patent Kokoku (B2) No. HEI 5[1993]-33661 (Shinmi et al.) discloses a sheet for road signs having optional convex molded shapes on the sheet's surface. Anchored on the convex molded shapes are reflective materials. The sheet comprises thermoplastic polymers and additives, such as fillers, pigments, plasticizers, and reflective materials. The convex molded shapes are made by forcing molten sheet material into a molding roller. The convex shapes are an integral part of the sheet. The molding roller determines features such as size, shape, and spacing of the convex shapes so that changes to those features cannot be made readily without changing the configuration of the molding roller, a situation similar to U.S. Pat. No. 4,988,541 (Hedblom).

Assignee's pending U.S. patent application Ser. No. 08/562,041 (filed Nov. 22, 1995) discloses a pavement marker comprising a base sheet, a discontinuous polymeric layer adhered on the base sheet, and a plurality of particles, such as microspheres and skid resistant particles, partially embedded in the polymeric layer. The polymeric layer is a thermoset polymer comprising a blocked isocyanate crosslinker and is applied to the base sheet as a pattern, e.g., a repeating pattern of hexagons, by a continuous process such as screen printing. Although the pavement marker is very useful and although the manufacturing process is generally streamlined, the pattern of the polymeric layer is predetermined by the screen printing method and cannot be changed readily without equipment changes.

An alternate method to elevate the optical elements above the pavement surface is to use retroreflective elements or aggregates having a core material that is coated with a multitudes of microspheres. Examples of such elements are disclosed in EP Patent No. 565,756 A2; U.S. Pat. Nos. 3,043,196; 3,171,827; 3,175,935; 3,274,888; 3,418,896, 3,556,637; 4,983,458; and Assignee's pending U.S. patent application Ser. No. 08/503,532, filed Jul. 18, 1995 now U.S. Pat. No 5,750,191. Although these retroreflective elements are extremely useful, some are not easily manufactured.

A need still exists for other retroreflective articles that provide good recovery of retroreflectivity after exposure to wet conditions but can be manufactured through a streamlined process for making such articles.

SUMMARY OF THE INVENTION

The present invention provides retroreflective articles having raised protuberances and an efficient method of making the articles. The inventive article has a profile created by use of protuberances comprising a thermoplastic polymer. Optical elements are embedded in the protuberances or in the binder layer disposed on the protuberance. Because the protuberances elevate the optical elements from the pavement surface, water drains away from the retroreflective portions of the inventive article more efficiently to allow for a quick recovery of retroreflectivity after a respite of rainfall.

In brief summary, the inventive retroreflective article may comprise or consist essentially of: (a) a base sheet having first and second major surfaces; (b) a plurality of nonintegral protuberances disposed on the first major surface of the base sheet, the protuberances comprising a thermoplastic polymer; (c) a plurality of optical elements being partially embedded in the protuberances; and (d) a light scattering agent in optical association with the optical elements such that incident light passing through the optical elements strikes the light scattering agent and is redirected towards its source.

The method of the invention may comprise or consist essentially of the steps: (a) providing a base sheet having nonintegral, thermoplastic protuberances and a light scattering agent; and (b) depositing optical elements onto the protuberances such that the optical elements are in optical association with the light scattering agent.

Pavement markings of the invention differ from known markings in that they use nonintegral thermoplastic protuberances. Use of these protuberances allows the pavement markings to be easily manufactured. Protuberances disclosed in U.S. Pat. No. 4,988,555 (Hedblom) and Japanese Patent Kokoku (B2) No. HEI 5[1993]-33661 (Shinmi et al.) are an integral part of the base sheet and therefore place significant limitations on the manufacturing process. Protuberances used in the present invention, however, may be formed by depositing thermoplastic particles on the base sheet. As described herein, alterations in the protuberance size and pattern can be made by changing the web speed, changing the size or shape of the polymeric particles, or changing the rate of particle deposition. Because articles of the invention have easy, streamlined manufacturing steps, they may be significantly less expensive to fabricate but can nonetheless demonstrate good retroreflectivity under wet conditions.

Articles of the present invention may be used in horizontal applications, such as markings on a road, or in vertical applications, such as markings on a Jersey barrier.

BRIEF DESCRIPTION OF THE DRAWINGS

The invention will be further explained with reference to the drawings, wherein.

These figures are idealized, are not to scale, and are intended to be merely illustrative and non-limiting.

DETAILED DESCRIPTION OF THE ILLUSTRATIVE EMBODIMENTS

Articles of the present invention rely on an optical system comprising a plurality of optical elements, that can be in the form of microspheres, embedded in nonintegral protuberances that comprise a thermoplastic polymer. The protuberances are formed on the first major surface of the base sheet. On the second major surface of the base sheet, there are optional reinforcing layers and adhesive layers to facilitate applying the inventive article to a surface, such as a roadway.

Figure 1:
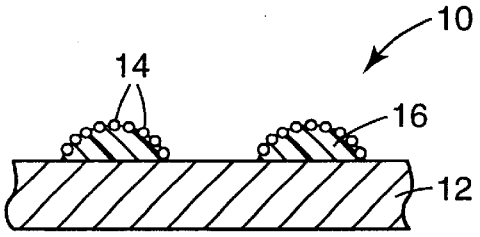
FIG. 1 is a cross-sectional view of retroreflective article 10 in accordance with the invention.

FIG. 1 shows an illustrative embodiment of the invention. Retroreflective article 10 contains base sheet 12 and optical elements 14 that are partially embedded in nonintegral protuberances 16 that contain a light scattering agent (not shown).

Figure 2:
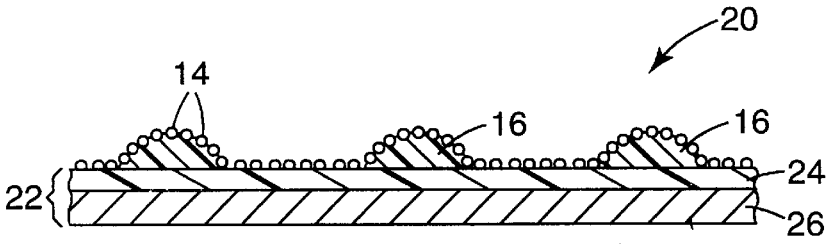
FIG. 2 is a cross-sectional view of another embodiment of retroreflective article 20 in accordance with the invention.

FIG. 2 shows another illustrative embodiment of the invention where a retroreflective article 20 contains multilayer base sheet 22 having thermoplastic layer 24 disposed on conformance layer 26. Nonintegral protuberances 16 contain light scattering agents (not shown) and are adhered to thermoplastic layer 24. Optical elements 14 are partially embedded in protuberances 16 as well as in thermoplastic layer 24.

Figure 3:
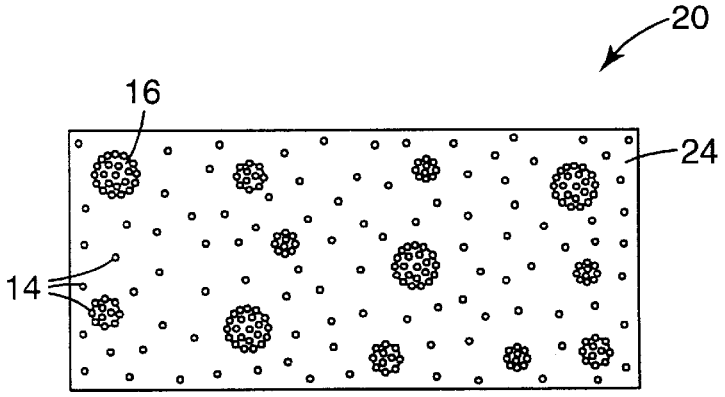
FIG. 3 is a plan view of the embodiment shown in FIG. 2.

FIG. 3 shows a plan view of the embodiment in FIG. 2 where nonintegral protuberances 16 of different sizes are scattered randomly on thermoplastic layer 24 of base sheet 22 (not shown). Optical elements 14 are embedded in protuberances 16 and on thermoplastic layer 24 of base sheet 22 (not shown).

Figure 4:
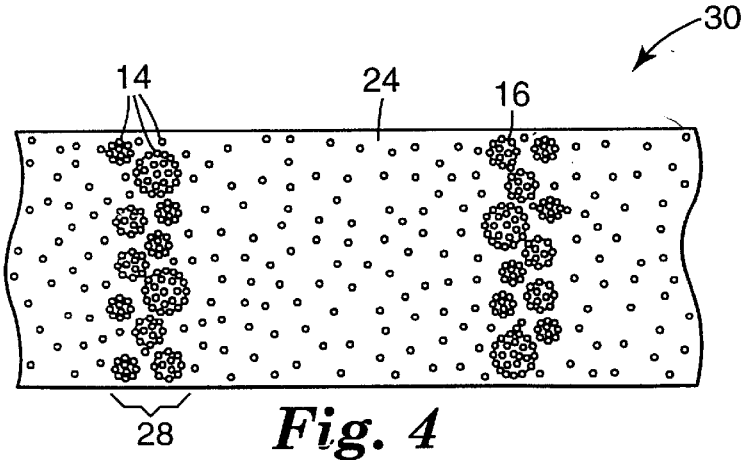
FIG. 4 is a plan view of another embodiment of retroreflective article 30 in accordance with the invention.

FIG. 4 shows a plan view of another embodiment of the invention where retroreflective article 30 contains nonintegral protuberances 16 gathered in clusters 28. As shown, optical elements 14 are embedded in protuberances 16 and on thermoplastic layer 24 of base sheet 22 (not shown).

Figure 5:
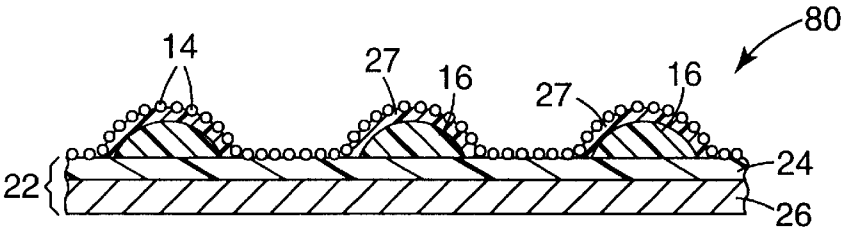
FIG. 5 is a cross-sectional view of another embodiment of retroreflective article 80 in accordance with the invention.

FIG. 5 shows another illustrative embodiment of the invention where retroreflective article 80 contains multilayer base sheet 22 having thermoplastic layer 24 disposed on conformance layer 26. Nonintegral protuberances 16 are coated with binder layer 27, which contains a light scattering agent (not shown). Optical elements 14 are partially embedded in binder layer 27 and on thermoplastic layer 24.

The protuberances elevate the optical elements above the substrate surface so that the optical elements are not submerged completely by water, and after a rainfall, the water can more readily drain away from the protuberances so that they can recover retroreflective performance rapidly. As used in this document, the term "protuberances" means a raised body or core that is thermoplastic—that is, capable of melting and flowing when exposed to a sufficient amount of heat. The protuberance optionally can include a binder layer disposed on the core. Although the protuberance is thermoplastic, the binder layer may be a thermoplastic or thermoset polymer.

Unlike the protuberances disclosed in U.S. Pat. No. 4,988,555 (Hedblom) and Japanese Patent Kokoku (B2) No. HEI 5[1993]-33661 (Shinmi et al.), protuberances of the invention can be nonintegral, meaning that they do not have to be formed as a monolithic element with the base sheet—that is, the protuberance and base sheet do not need to be formed as a single component that lacks an interface therebetween.

The protuberances provide a profiled structure having a substantially vertical surface resulting in more efficient retroreflection. As between an article with a vertical profile, i.e., an article with protuberances, and one without a vertical profile, i.e., a substantially flat article, the one with a vertical profile provides generally more efficient retroreflection because the optical elements on the vertical surfaces are able to capture more incident light and reflect it back to its source.

The protuberances also provide an enhanced measure of wearability over similarly constructed flat articles without such protuberances. As used herein, "wearability" means the ability of an article to withstand repeated impact and abrasion from vehicle tires thereby prolonging the useful life of the inventive article. Enhanced wearability of the inventive article is achieved because vehicle tires make contact with the protuberances first, thereby wearing them down before wearing down the remainder of the inventive article.

Illustrative examples of suitable thermoplastic polymers for use as protuberances include fluoropolymer, polycarbonate, acrylic, polyester, polyurethane, polyvinyl chloride, polyolefin copolymers, and blends thereof The polymer chosen for the protuberance may be different from that of the thermoplastic layer of a multilayer base sheet. Care should be taken to select a material for the protuberance that has good adhesion to the base sheet, good adhesion to the optical elements, and is sufficiently durable to withstand repeated traffic impact. By "good adhesion" it is meant that the protuberances retain their adhesion to the base sheet and to the optical elements after repeated impact by vehicle tires.

The protuberances can be of essentially any desired shape in horizontal cross section, i.e., in the plane parallel with the surface of a substrate, such as a road pavement. For example, the horizontal cross section of the protuberance may be ellipsoidal, circular, oblong, rectangular, irregular, or regular. In some embodiments where optimum retroreflective brightness from all orientations is desired, e.g., a pavement marking for intersections, the horizontal cross section of the protuberance is preferably substantially circular because brightness from all orientations can be achieved. In general, a protuberance having circular cross section creates a substantially hemispherical protuberance, or some portion thereof.

The protuberances are about 0.2 to about 6.0 millimeters in height and about 1 to 20 millimeters in diameter to be of sufficient size so as not to be submerged completely by water in a typical rain shower. More preferably, the protuberances are about 1 to about 4 millimeters in height and are about 2 to about 8 millimeters in diameter at the base. The latter sizes are more preferred because they tend to provide a good balance between retroreflectivity and wearability, aid in draining water away from the retroreflective portions, and provide a wear surface to prolong the pavement marker's life. Protuberances that are too large may inhibit the retroreflective article's conformance to the substrate, resulting in a reduced adhesive bond. Pavement markers that employ protuberances that may be used in this invention are disclosed in Assignee's copending U.S. application Ser. No. 08/895,128, filed on the same day as the parent application of this application, now U.S. Pat. No. 5,941,655.

As shown in FIG. 3, protuberances 16 may be spaced in a generally random manner. The random spacing can be achieved by freely depositing thermoplastic resin particles on base sheet 12, 22 (FIGS. 1, 2, and 5). Base sheet 12, 22 may be heated so that once the thermoplastic particles contact the base sheet, they soften to yield protuberances of generally hemispherical shape. A less than optimum protuberance spacing may be used in applications where optimum brightness is not required. This feature of random yet controllable protuberance placement permits a simplified, less expensive manufacturing process to be used in producing a pavement marking that has elevated optical elements.

As shown in FIG. 4, clusters of protuberances 28 may be formed on the base sheet to provide a plurality of protuberances spaced in such a fashion so as to minimize shadowing effects and maximize retroreflective performance. Preferably, the surface area occupied by the protuberances is less than fifty percent of the base sheet, more preferably about 10 to about 40 percent, in order to allow for good conformance of the inventive article to a substrate, e.g., to a roadway, a guard rail, or other structures. The spacing between the protuberances varies depending on the desired pavement marking configuration. For example, in FIG. 3, nonintegral protuberances 16 are spaced, on average, a larger distance apart than individual protuberances within clusters 28 of FIG. 4.

If desired, to increase optical element adhesion, a binder solution can be coated and cured on the protuberances to yield a binder layer. The binder layer can be a thermoplastic or thermoset polymer. Preferred binder solutions suitable for use in the invention are disclosed in U.S. Pat. No. 4,988,555 (Hedblom), which refers to such solutions as "bead bond materials." When a binder layer is used, optical elements will be embedded in it and not directly in the protuberances. In such a case, the binder layer contains about 5 to about 20 volume percent of a light scattering agent and the protuberance does not necessarily need to contain light scattering agents. U.S. Pat. No. 4,988,555 (Hedblom) discloses preferred coating methods for coating two different binder solutions to a protuberance.

The protuberances can have first and second layers, where the second layer lies under the first layer, the first layer comprising a thermoplastic polymer and a diffuse reflector pigment, and the second layer comprising a thermoplastic polymer and specular pigment (see U.S. Pat. No. 5,417,515 (Hachey et al.)). A dual reflecting layer protuberance could be made, for example, using thermoplastic particles with an inner body comprising a specular pigment and an outer sheath comprising a diffuse pigment. When a thermoplastic particle of such composition is exposed to heat to form a protuberance, the first outer layer should be of sufficient thickness so that the portion of the optical elements embedded in the protuberance contacts both the outer diffuse pigment layer and the inner specular pigment layer. Alternatively, a binder layer having a diffuse reflector pigment can be disposed on a protuberance comprising a thermoplastic polymer and a specular reflector pigment.

A dual layer reflecting protuberance can provide high retroreflectivity levels over a wide range of distances and entrance angles, regardless of the retroreflective article's orientation. The specular layer is best suited for returning light that enters close to normal, while the diffuse layer is best suited for returning light at the larger entrance angles between 65° and 90° from normal with respect to the plane formed by the protuberance in contact with the microspheres. Because the protuberance provides a vertical component, higher efficiency of retroreflectivity at driver geometry may be achieved.

Light scattering agents are in optical association with the optical elements. The term "optical association" means that when a light ray strikes the optical element and is refracted, the light ray is capable of striking the light scattering agent so that it can be reflected back into the optical elements. Typically, the light scattering agent resides in a layer that supports the optical elements—that is, in the protuberance or in the binder layer disposed on the protuberance. When the optical elements are partially embedded in the protuberance, it comprises a light scattering agent. When the optical elements are partially embedded in a binder layer disposed on the protuberance, the binder layer contains a light scattering agent.

Light scattering agents suitable for use in the present invention include specular pigments and diffuse pigments. Specular pigment particles are generally thin and plate like. Light striking the pigment particles is reflected at an angle equal but opposite to the angle at which it entered. Suitable examples of specular pigments for use in the invention include pearlescent pigments, mica, and nacreous pigments. Diffuse pigments are generally fine particles that are relatively uniform in size. The pigment particles tend to be oriented in many different directions, so that light hitting the particles is reflected back at a number of angles, including back along the path of incident light. An example of a preferred diffuse pigment is titanium dioxide.

Illustrative examples of suitable light scattering agents for use in protuberances include pigment particles selected from the group consisting of zinc oxide, zinc sulfide, lithophone, zircon, zirconium oxide, barium sulfate, titanium dioxide, and combinations thereof as disclosed in U.S. Pat. No. 5,286,682 (Jacobs et al.). These pigments reflect white light. Retroreflective articles using these pigments have the advantage of being able to reflect distinct night time colors without using potentially toxic metals such as cadmium, chromium, and lead-based pigments, when they are used in combination with colored optical elements.

Other light scattering agents may be used to reflect other colors. An illustrative example is bismuth vanadate, which reflects yellow light and can be used with colorless optical elements to yield a yellow pavement marking. Some organic lakes and organic pigments of controlled particle size may also be used.

Typically, the light scattering agents are present at about 5 to 20 volume percent of the layer supporting the optical elements, i.e., the protuberances or the binder layer, if used. Preferably, the scattering agents are present are present at about 5 to 15 volume percent and more preferably about 7 to about 13 volume percent. This latter range is preferred because it provides a good balance between the amount of scattering agents needed for reflectivity and flowability of the thermoplastic material during transformation to protuberances. A light scattering agent might also include a layer of specularly reflective material such as aluminum or silver metal or dielectric layer disposed in optical association with the optical elements.

The base sheet used in the present invention can have a single or a multilayer construction. The base sheet can be a single layer, or as shown in FIG. 2, it can be a multilayer laminate, e.g., a thermoplastic layer disposed on a conformance layer. Whether single or multilayer in construction, the base sheet is desirably conformable so as to be easily applied to a non-planar substrate.

In a multilayer base sheet construction, there is typically a thermoplastic layer disposed on a conformance layer. The conformance layer can be polymeric. U.S. Pat. No. 4,490,432 (Jordan) discloses an illustrative conformance layer that is suitable for use in the present invention. This type of conformance layer comprises a non-crosslinked elastomer (e.g., acrylonitrile-butadiene, neoprene, nitrile rubbers, and polyacrylates), a thermoplastic reinforcing polymer (e.g., polyolefins, vinyl copolymers, polyethers, polyacrylates, styrene-acrylonitrile copolymers, polyesters, polyurethanes, and cellulose derivatives), and a particulate inorganic fillers (e.g., magnesium silicate, talc, and mica).

Another polymeric conformance layer suitable for use in the present invention is disclosed in U.S. Pat. No. 5,194,113 (Lasch et al.) which includes a ductile thermoplastic polymer and a nonreinforcing mineral particulate. This type of conformance layer comprises from about 50 to about 85 volume percent of thermoplastic polymer and about 15 to about 50 volume percent of the mineral particulate, the particulate having a mean particle size of at least one micrometer. Disclosed illustrative examples of suitable thermoplastic polymers included polyolefin, which may be chosen from the group consisting of polyethylene, ethylene copolymers, polypropylene, ethylene-propylene-diene terpolymers, polybutylene, and mixtures thereof. Disclosed illustrative examples of suitable mineral particulate include, e.g., calcium carbonate, aluminum silicate, talc, alumina trihydrate, silica, wollastonite, mica, feldspar, barytes, calcium silicate, attapulgite, and various hollow beads of synthetic and natural minerals.

Yet another polymeric conformance layer suitable for use in the present invention is disclosed in U.S. Pat. No. 5,643,655 (Passarino) which is an essentially chlorine free conformance layer comprising a calandered, unvulcanized compound based on acrylonitrile butadiene rubber (NRB) and modifying agents to make an elastomer precursor. The modifying agents improve the mechanical and physical properties of natural or synthetic elastomer.

The conformance layer can be metallic. Metallic conformance layers should be of sufficient thickness so as to be ductile and conformable, yet have sufficient strength so as to be processable. Illustrative examples of suitable materials for use as metallic conformance layers include aluminum foil and copper foil. Aluminum foil is preferred because it has good conformance properties and is commercially available at a relatively low cost.

For ease of manufacturing, the thermoplastic layer may be laminated to or extruded directly on the conformance layer to yield a multilayer base sheet. In a multilayer construction, it is desirable to have good adhesion between the thermoplastic layer and the conformance layer. Illustrative examples of suitable materials for use as thermoplastic layer include polyolefin copolymers, polyurethane, polyvinyl chloride, and blends thereof Preferred polyolefin copolymers are ethylene methacrylic acid (EMAA) and ethylene acrylic acid (EAA) because they have very good adhesion to a variety of materials and are commercially available.

The thermoplastic layer may contain light scattering agents similar to those used in protuberances and binder layer if used. The light scattering agents comprises 5 to 20 volume percent of the thermoplastic layer. Preferably, scattering agents are present at about 5 to about 15 volume percent and more preferably about 7 to about 13 volume percent of the thermoplastic layer to provide a good balance between the amount of scattering agents needed for reflectivity and flowability of the thermoplastic layer during processing. The scattering agents can be formulated into the polymeric particles or can be tumble mixed with the thermoplastic resin and extruded into a film. The advantage of having light scattering agents in the thermoplastic layer is that any optical elements embedded therein will also retroreflect incident light. As shown in FIG. 2, optical elements 14 are embedded in protuberances 16 as well as thermoplastic layer 24, both of which retroreflect incident light.

Typically the thermoplastic layer is less than 0.010 inch (0.25 mm) thick to provide a balance of properties with the conformance layers so as not to substantially inhibit conformability of the inventive article to the substrate. Preferably, the thermoplastic layer is about 0.002 to about 0.006 inch (0.05 to 0.2 mm) thick to strike a good balance between conformability and base sheet integrity.

The optical elements used in the present invention can be light transmissive microspheres. They act as spherical lenses that refract incident light into the protuberances or binder layer which contain the light scattering agent. The light scattering agents reflect a portion of the incident light to direct it back into the microsphere where the light is again refracted but this time back towards the light source.

The microspheres can be glass or non-vitreous ceramic. Non-vitreous ceramic microspheres are typically preferred for greater durability and abrasion resistance. Preferred non-vitreous ceramic microspheres are disclosed in U.S. Pat. Nos. 4,564,556 (Lange); 4,758,469 (Lange); 4,772,511 (Wood et al.); and 4,931,414 (Wood). Glass microspheres can provide a desirable balance of lesser durability at lower cost. Typically, the microspheres are about 100 to about 600 micrometers (0.004 to 0.02 inch) in diameter and have a refractive index of about 1.5 to about 2.2.

As shown in FIG. 1, the microspheres may be placed only on the protuberances, if desired. Such selective placement is achieved by using a base sheet that is not receptive to the microspheres. A metal conformance layer, such as aluminum, is an illustrative example of such a base sheet. Other examples include crosslinked polymers or thermoplastic polymers that have higher melt temperature than the softening point of the protuberances.

The microspheres also can be deposited on the base sheet and the protuberances as shown in FIG. 2, where thermoplastic layer 24 of base sheet 22 is receptive to the microspheres. The microspheres can be deposited on the binder layer as shown in FIG. 5.

In pavement marking applications, it is important that motorists distinguish between different colored marker, e.g., between white and yellow markers. If desired, light transmissive colorants may be added to the microspheres to enhance both daytime and nighttime color. For example, a yellow colorant could be added to the microspheres to make a pavement marker that retroreflects yellow light. See, for example, U.S. Pat. No. 5,286,682 (Jacobs et al.).

Figure 6:
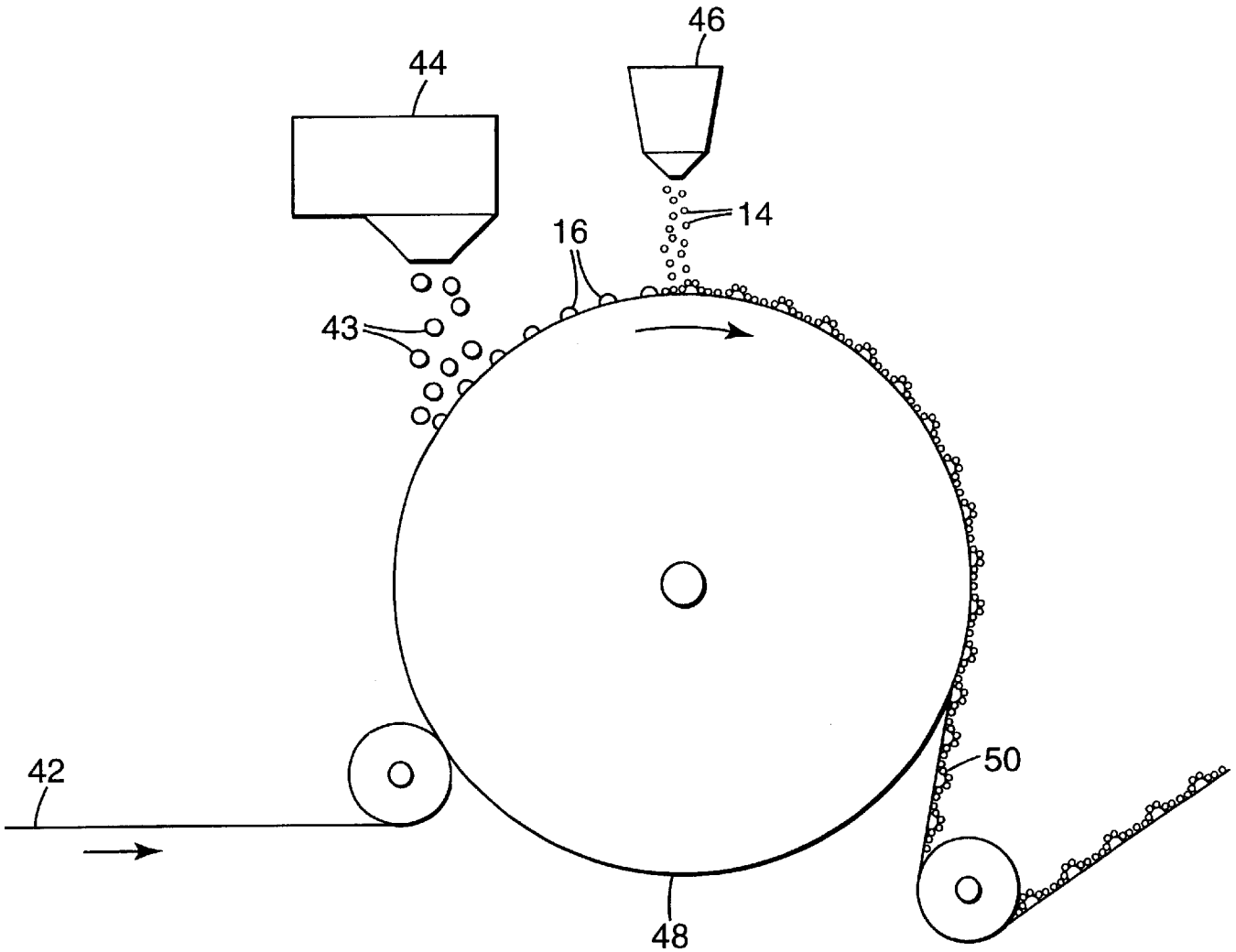
FIG. 6 is a schematic view of a method of making retroreflective article 50 in accordance with the invention.

FIG. 6 shows a process of making retroreflective article 50 of the invention. As base sheet 42 traverses the surface of heated hot can 48, thermoplastic particles 43 containing light scattering agents (not shown) are released from a reservoir 44 and are deposited on base sheet 42. When thermoplastic particles 43 contact base sheet 42 and adhere thereto, they soften, flow, and deform to yield protuberances 16. As base sheet 42 continues to traverse the surface of hot can 48, optical elements 14 are released from applicator 46 and with the aid of gravity become partially embedded in protuberance 16 and in any other location on the top surface of base sheet 42 that is receptive to the optical elements. A finished product 50 is allowed to cool before being wound up into a roll.

Figure 7:
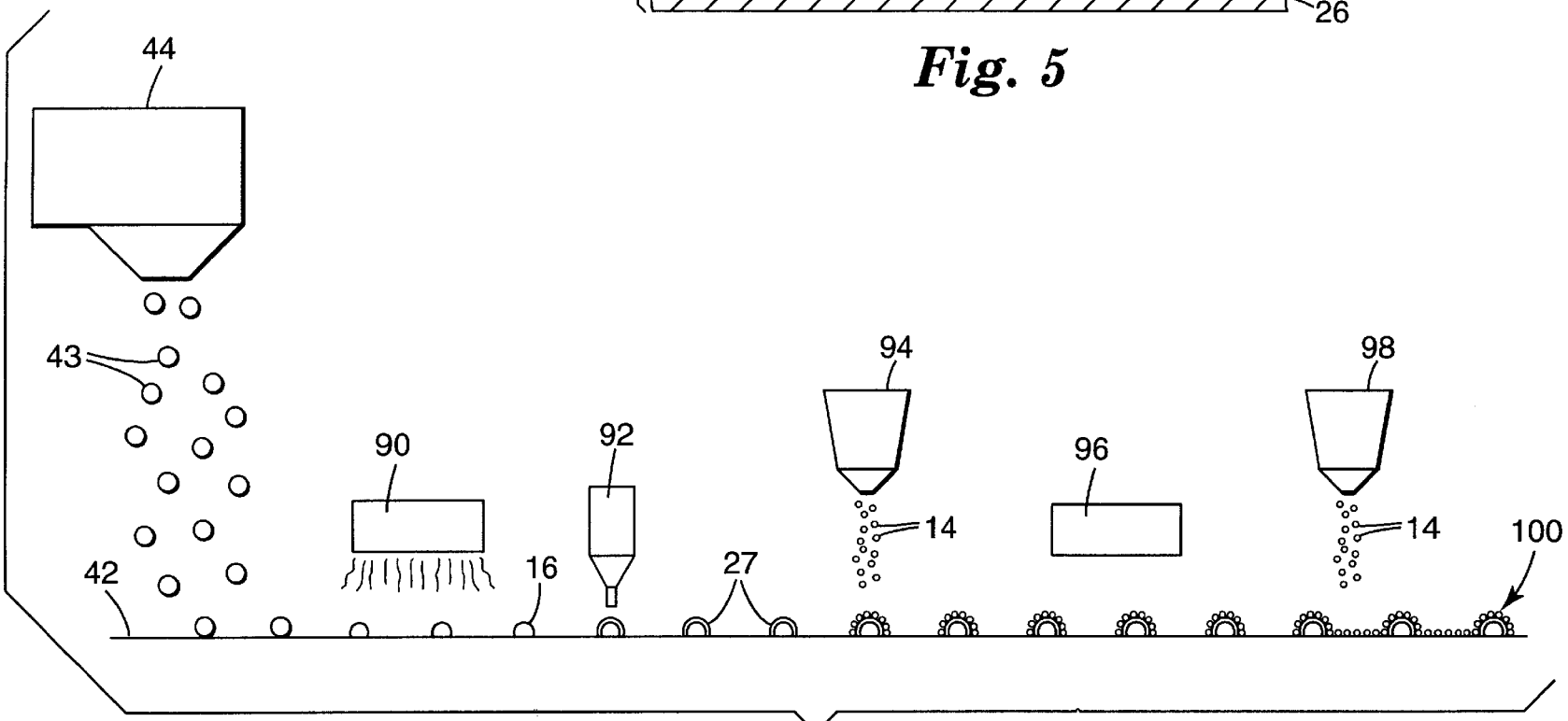
FIG. 7 is a schematic view of another method of making retroreflective article 100 in accordance with the invention.

FIG. 7 shows a process of making retroreflective article 100 of the invention. Reservoir 44 releases thermoplastic particles 43 on to base sheet 42. Heat source 90 causes thermoplastic particles 43 to soften, melt, and flow forming nonintegral thermoplastic protuberance 16. The protuberances are allowed to cool and solidify. Coating unit 92 applies a binder solution on to the protuberances. A preferred coating method is described in U.S. Pat. No. 4,988,541 (Hedblom). While the binder solution is still wet, optical elements 14, with the aid of gravity, are deposited on the binder. Cure zone 96 cures and, if necessary, crosslinks the binder solution to form binder layer 27. If a multilayer base sheet comprising a thermoplastic layer disposed on a conformance layer is used, additional optical elements 14 may be deposited on to the base sheet as shown.

A variety of heat sources can be used to soften thermoplastic particles into protuberances. As shown in FIG. 6, hot can 48 supplies the heat to soften thermoplastic particles 43. A heated oven can also be used to soften the particles. For example, as the base sheet moves through an oven, the thermoplastic particles previously deposited thereon soften, melt, and deform into protuberances. Also, a base sheet carrying thermoplastic particles can be made to pass under banks of radiant heaters, such as Calrod™ heaters or infrared lamps, to deform the particles into protuberances.

The final shape of the protuberances can vary depending on, for example, (1) the processing conditions such as the temperature and method of heating, (2) the original shapes of the thermoplastic particles, (3) the melting characteristic of the thermoplastic particles, and (4) the surface of the base sheet that comes into contact with the thermoplastic particles. If there is substantial amount of heat causing the thermoplastic particles to soften substantially, the final shape of the protuberance may be quite flat. If there is not as much heat, the final shape of the protuberance may be more hemispherical. When the polymer particles are applied randomly and then subsequently heated, some particles may flow together upon heating. Although the resulting protuberance may not have substantially hemispherical shape, there is generally still significant reflectivity from this now ellipsoidal protuberance.

The density and spacing of the protuberances can be changed easily by changing the base sheet web speed, changing the size of the thermoplastic particles, or changing the rate of particle deposition.

In the fabrication process, it is typical to add skid resistant particles, if desired, at the same time or just after the optical elements are deposited on to the base sheet. The optical elements and skid resistant particles are applied to the first major surface, i.e., the top surface of the base sheet by, e.g., sprinkling, scattering, etc. Examples of conventional skid-resistant particles include corundum (aluminum oxide) and quartz (sand, silicon dioxide, or micronized quartz). Preferred skid-resistant particles are disclosed in U.S. Pat. Nos. 4,937,127 (Haenggi et al.); 5,053,253 (Haenggi et al.); 5,094,902 (Haenggi et al.); and 5,124,187 (Haenggi et al.).

Components of the inventive article that lie underneath the retroreflective base sheet are preferably selected to fit the application desired. For example, a scrim adhesive (i.e., a polymeric scrim that has been saturated with an adhesive) imparts additional strength, for example, for strength in removablility or for other desired wear characteristics, as well as selected adhesive characteristics to the retroreflective article.

EXAMPLES

The following examples are provided to illustrate different embodiments and details of the invention. Although the examples serve this purpose, the particular ingredients and amounts used as well as other conditions and details are not to be construed in a manner that would unduly limit the scope of this invention.

Example 1

A white pavement marking of the invention was made as follows. White resin pellets of Nucrel™ 699, an ethylene methacrylic acid copolymer (EMAA), available from Du Pont Company, Wilmington, Delaware, containing 20 weight percent titanium dioxide were extruded into a white film about 0.0045 inch (0.11 mm) thick on to a 0.003 inch (0.076 mm) thick deadsoft aluminum foil carrier to yield a multilayer base sheet.

The base sheet was brought at a rate of 3.8 feet per minute (0.91 m/min) into contact with a hot can having a diameter of about 2 feet (0.6 m), with the foil side contacting the hot can at a temperature was about 400° F. (204° C.), sufficiently hot to bring the white film to a nearly molten condition. Pigmented cylindrical particles of EMAA, with a 0.039 inch (1 mm) diameter and a 0.079 inch (2 mm) height, having 50 weight percent titanium dioxide were sprinkled onto the EMAA side of the base sheet. The pigmented particles were coated onto the base sheet after about 2 to 3 inch (5 to 8 cm) of wrap on the hot can. As the particle coated base sheet continued to traverse the surface of the hot can, the initial cylindrical shape of the particle softened and took on a generally hemispherical shape to yield protuberances. This base sheet then traveled under a particle coater from which glass microspheres were sprinkled at a coating weight of about 0.0066 lb. (3.0 grams) of glass microspheres per 4 inch by 6 inch (10 by 15 cm) of base sheet. The glass microspheres had about a 1.9 refractive index. The glass beads were coated onto the laminate after about 10 inch (25 cm) of wrap on the hot can. Final embedment after the last 40 inch (102 cm) of wrap on the hot can was about 60% of the microsphere's diameter. After leaving the surface of the hot can, the particle coated base sheet was cooled under ambient conditions prior to winding it up.

Example 2

A yellow pavement marker was made similarly to Example 1 except that a 0.0045 inch (0.11 mm) thick yellow EMAA film was extruded using EMAA resin containing about 12 weight percent yellow pigment Colour Index (C.I.) Pigment Yellow 183 (paliotol yellow), available from Ciba-Geigy, and 2.5 weight percent of titanium dioxide. Thus, the base sheet was a composite comprising a yellow thermoplastic layer disposed on an aluminum conformance layer. Furthermore, yellow glass microspheres containing 1.8 weight percent $CeO_2$ were used. The microspheres were 0.079 to 0.024 inch (200 to 600 micrometers) in diameter.

Example 3

A red pavement marker was made similarly to Example 2 except that a 0.0045 inch (0.11 mm) thick red EMAA film was extruded using EMAA resin containing about 20 weight percent red pigment C.I. Pigment Red 170, and 2.5 weight percent of titanium dioxide. The base sheet was a composite comprising a red thermoplastic layer disposed on an aluminum conformance layer. The yellow glass microspheres as described in Example 2 were used for optical elements. The same titanium dioxide pigmented cylindrical particles used in Example 1 were used here to make protuberances.

Example 4

A black pavement marker was made similarly to Example 2 except that a 0.0045 inch (0.11 mm) black EMAA film was extruded using EMAA resin containing about 30 weight percent C.I. Black 7 pigment. The base sheet was a composite comprising a black thermoplastic layer disposed on an aluminum conformance layer. The yellow glass microspheres as described in Example 2 were used for optical elements. The same titanium dioxide pigmented cylindrical particles used in Example 1 were used here to make protuberances.

Example 5

A white pavement marking was made similarly to Example 1 except that after the EMAA pigmented particles were applied to the multilayer base sheet to form protuberances, the resulting intermediate sheeting was allowed to cool. Subsequently, in a separate step, the intermediate sheeting was reheated and was then coated with glass beads as in Example 1.

Example 6

A pavement marking of the invention was made as follows. An aluminum conformance layer was allowed to contact a 2 feet (0.6 m) diameter hot can rotating at 3.8 feet per minute (0.91 mm.) Pigmented cylindrical particles of EMAA, with a 0.04 inch (1 mm) diameter and 0.08 inch (2 mm) height, having 50 weight percent titanium dioxide were dropped onto an aluminum conformance layer to form protuberances. Glass microspheres having a refractive index of about 1.9 were immediately thereafter sprinkled on protuberances to yield a pavement marking.

All references cited herein are incorporated by reference in its entirety.

What is claimed is:

1. A method for making a retroreflective article comprising:

providing a base sheet having first and second major surfaces;

depositing a plurality of thermoplastic resin particles on the first surface of the base sheet; the thermoplastic resin comprising a light scattering agent;

heating the thermoplastic resin to a softened state to form thermoplastic protuberances on the base sheet; and while the protuberances are tacky, depositing optical elements on the protuberances such that the optical elements are in optical association with the light scattering agent.

2. The method of claim 1 further comprising applying a binder layer on the protuberances.

3. The method of claim 2 wherein the binder layer comprises about 5 to about 20 volume percent of the light scattering agent.

4. The method of claim 1 wherein the base sheet comprises a layer selected from the group consisting of ductile metals, thermoset polymers, and thermoplastic polymers having a melting point higher than the softening point of the protuberances.

5. The method of claim 1 wherein the base sheet comprises a conformance layer.

6. The method of claim 5 wherein the base sheet further comprises a thermoplastic layer disposed on the conformance layer.

7. The method of claim 6 wherein the thermoplastic layer is of a different composition than the thermoplastic material of the protuberances.

8. The method of claim 6 wherein the thermoplastic layer comprises about 5 to about 20 volume percent of a light scattering agent.

9. The method of claim 1 wherein the protuberances comprise thermoplastic material selected from the group consisting of fluoropolymer, polycarbonate, acrylic, polyester, polyurethane, polyvinyl chloride, polyolefin copolymers, and blends thereof.

10. The method of claim 1 wherein the protuberances are placed randomly on the first major surface of the base sheet.

11. The method of claim 1 wherein the protuberances are placed in regularly spaced clusters on the first major surface of the base sheet.

12. The method of claim 1 wherein the protuberances are in contact with less than 50 percent of the first major surface of the base sheet.

13. The method of claim 1 wherein the protuberances are hemispherical in shape.

14. The method of claim 1 wherein the protuberances have an average height of about 200 to about 6000 microns.

15. The method of claim 1 wherein the protuberances comprises about 5 to about 20 volume percent of the light scattering agent.

16. The method of claim 1 wherein the light scattering agent includes pigment particles selected from the group consisting of zinc oxide, zinc sulfide, lithophone, zircon, zirconium oxide, barium sulfate, titanium dioxide, pearlescent pigments, mica, nacreous pigments, and combinations thereof.

17. The method of claim 1 wherein the optical elements are microspheres selected from at least one of the group consisting of glass and non-vitreous ceramic.

18. The method of claim 1 wherein the optical elements have an average refractive index of about 1.5 to about 2.2.

19. The method of claim 1 further comprising appyling a colorant in at least one of the group consisting of the base sheet, protuberances, and optical elements.

20. The method of claim 1 further comprising applying skid-resistant particles on the first major surface of the base sheet and on the protuberances.

* * * * *

UNITED STATES PATENT AND TRADEMARK OFFICE

CERTIFICATE OF CORRECTION

PATENT NO. : 6,326,053 B1
DATED : December 4, 2001
INVENTOR(S) : Stump, Larry K.

It is certified that error appears in the above-identified patent and that said Letters Patent is hereby corrected as shown below:

Column 7,
Line 34, delete the second occurrence of "are present".

Signed and Sealed this

Eighth Day of April, 2003

JAMES E. ROGAN
*Director of the United States Patent and Trademark Office*